US009541886B2

(12) United States Patent
Akamatsu et al.

(10) Patent No.: US 9,541,886 B2
(45) Date of Patent: Jan. 10, 2017

(54) IMAGE FORMING APPARATUS

(71) Applicant: FUJI XEROX CO., LTD., Tokyo (JP)

(72) Inventors: Hiroaki Akamatsu, Kanagawa (JP); Masaki Hirakata, Kanagawa (JP); Tsutomu Sugimoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/810,719

(22) Filed: Jul. 28, 2015

(65) Prior Publication Data

US 2016/0266536 A1 Sep. 15, 2016

(30) Foreign Application Priority Data

Mar. 10, 2015 (JP) ..... 2015-047399

(51) Int. Cl.
*G03G 21/00* (2006.01)
*G03G 21/10* (2006.01)
*G03G 15/16* (2006.01)

(52) U.S. Cl.
CPC ..... *G03G 21/0017* (2013.01); *G03G 15/161* (2013.01); *G03G 21/0005* (2013.01); *G03G 21/0011* (2013.01); *G03G 21/10* (2013.01); *G03G 2221/0005* (2013.01)

(58) Field of Classification Search
CPC ..... G03G 21/00
USPC ..... 399/159, 350
See application file for complete search history.

(56) References Cited

U.S. PATENT DOCUMENTS 4,848,141 A * 7/1989 Oliver ..... G01N 3/405 73/81
2007/0252129 A1* 11/2007 Yagi ..... H01L 31/032 257/2
2008/0254379 A1* 10/2008 Iwanaga ..... G03G 5/047 430/66
2008/0260427 A1* 10/2008 Iwanaga ..... G03G 5/14704 399/159
2010/0247188 A1* 9/2010 Fukuda ..... G03G 21/0017 399/350
2010/0247189 A1* 9/2010 Akamatsu ..... G03G 21/0029 399/350
2013/0016993 A1* 1/2013 Akamatsu ..... G03G 21/0029 399/102
2015/0177674 A1* 6/2015 Tano ..... G03G 21/0017 399/350
2015/0277342 A1* 10/2015 Akamatsu ..... G03G 21/0017 399/350

FOREIGN PATENT DOCUMENTS

JP 2006-064918 * 3/2006 ..... G03G 21/10
JP 2006-64918 A 3/2006
JP 2006-259466 * 9/2006 ..... G03G 21/10
JP 2006-259466 A 9/2006

* cited by examiner

*Primary Examiner* — Clayton E Laballe
*Assistant Examiner* — Kevin Butler
(74) *Attorney, Agent, or Firm* — Sughrue Mion, PLLC

(57) ABSTRACT

An image forming apparatus includes an image bearing member having an inorganic protective layer on a surface thereof, a cleaning blade having an inclined surface cut out at a corner portion on a side of the image bearing member, and a support portion that supports the cleaning blade so that the inclined surface is in contact with the image bearing member.

6 Claims, 10 Drawing Sheets

IMAGE FORMING APPARATUS

CROSS-REFERENCE TO RELATED APPLICATIONS

This application is based on and claims priority under 35 USC 119 from Japanese Patent Application No. 2015-047399 filed Mar. 10, 2015.

BACKGROUND (i) Technical Field

The present invention relates to an image forming apparatus (ii) Related Art

A cleaning blade has hitherto been used as a cleaner that removes residual toner and the like from a surface of an image bearing member, such as a photoconductor, in a copying machine, a printer, and a facsimile using an electrophotographic system.

SUMMARY

According to an aspect of the invention, there is provided an image forming apparatus including an image bearing member having an inorganic protective layer on a surface thereof, a cleaning blade having an inclined surface cut out at a corner portion on a side of the image bearing member, and a support portion that supports the cleaning blade so that the inclined surface is in contact with the image bearing member.

BRIEF DESCRIPTION OF THE DRAWINGS

An exemplary embodiment of the present invention will be described in detail based on the following figures, wherein.

DETAILED DESCRIPTION

An image forming apparatus according to an exemplary embodiment of the present invention will be described below with reference to the drawings.

Figure 1:
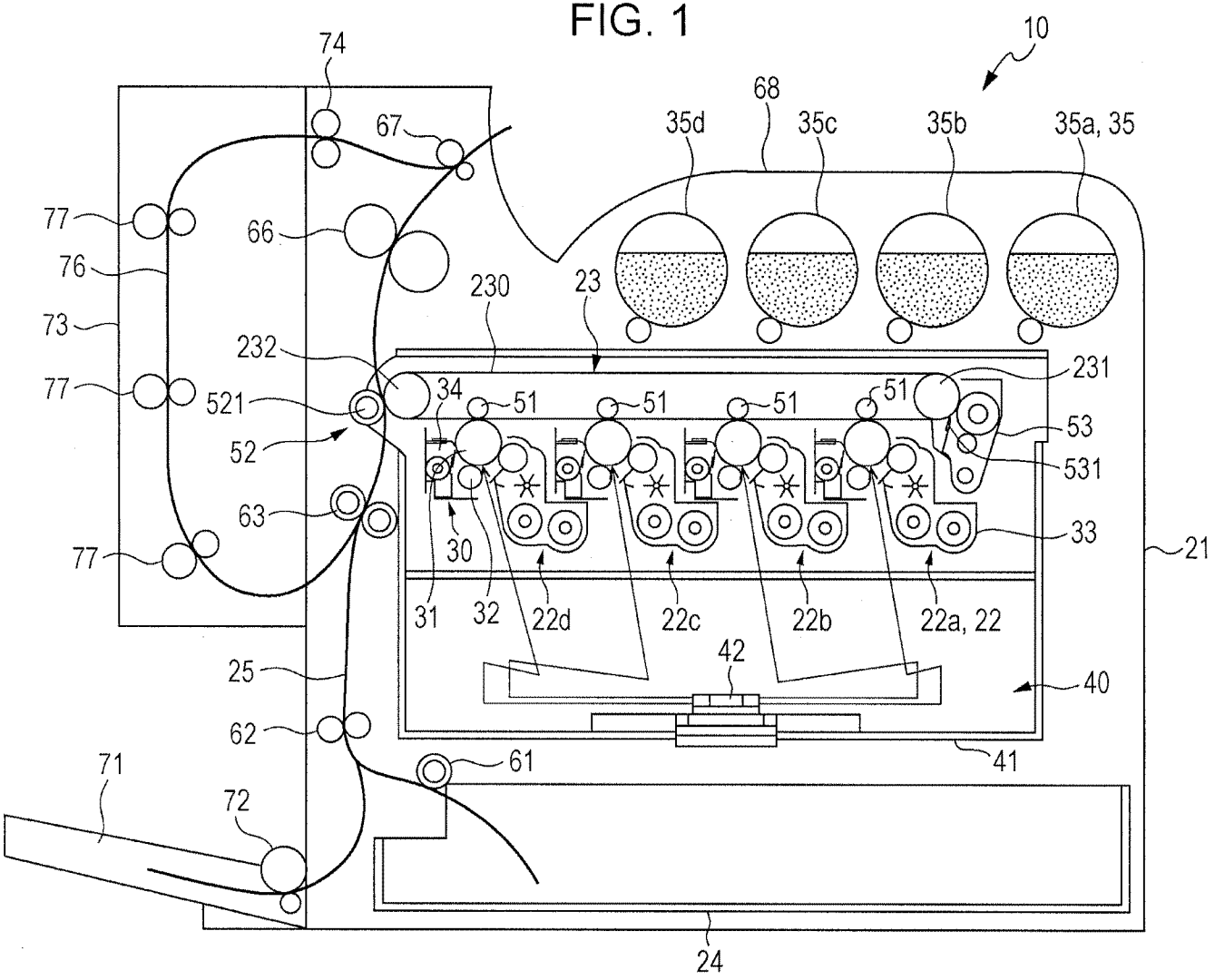
FIG. 1 is a structural view of an image forming apparatus according to an exemplary embodiment of the present invention.

FIG. 1 is a structural view of an image forming apparatus 10 of a so-called tandem type according to the exemplary embodiment.

Referring to FIG. 1, the image forming apparatus 10 includes a body housing 21, image forming units 22 (22*a* to 22*d*), a belt module 23, a recording-medium supply cassette 24, a recording-medium transport path 25, photoconductor units 30, photoconductor drums 31, and developing units 33. The image forming apparatus 10 further includes cleaning devices 34, toner cartridges 35 (35*a* to 35*d*), an exposure unit 40, a unit case 41, a polygonal mirror 42, first transfer devices 51, a second transfer device 52, a belt cleaning device 53, a feed roller 61, transport rollers 62, and registration rollers 63. The image forming apparatus 10 further includes a fixing device 66, output rollers 67, a paper output section 68, a manual supply device 71, a feed roller 72, a duplex printing unit 73, guide rollers 74, a transport path 76, transport rollers 77, an intermediate transfer belt 230, support rollers 231 and 232, a second transfer roller 521, and a cleaning member 531.

As illustrated in FIG. 1, in the image forming apparatus 10 of the tandem type, image forming units 22 (specifically, 22*a*, 22*b*, 22*c*, and 22*d*, hereinafter referred to as "22*a* to 22*d*") corresponding to four colors (yellow, magenta, cyan, and black in the exemplary embodiment) are arranged inside a body housing 21. A belt module 23 including an intermediate transfer belt 230 to be circularly transported in the arrangement direction of the image forming units 22 is disposed above the image forming units 22. Further, in the image forming apparatus 10, a recording-medium supply cassette 24 that contains recording media such as paper (not illustrated) is disposed in a lower part of the body housing 21, and a recording-medium transport path 25 serving as a transport path for the recording media from the recording-medium supply cassette 24 extends in the vertical direction.

In the exemplary embodiment, for example, the image forming units 22 (22*a* to 22*d*) form yellow, magenta, cyan, and black toner images in this order from the upstream side of the circulating direction of the intermediate transfer belt 230 (the arrangement order is not limited thereto). The image forming units 22 include their respective photoconductor units 30 and developing units 33. One exposure unit 40 is common to the image forming units 22.

Here, each photoconductor unit 30 is provided in the form of a sub-cartridge by combining a photoconductor drum 31 serving as an example of an image bearing member, a charging device (charging roller) 32 for charging the photoconductor drum 31 beforehand, and a cleaning device 34 for removing residual toner on the photoconductor drum 31.

Each developing unit 33 develops an electrostatic latent image formed on the charged photoconductor drum 31 by being exposed by the exposure unit 40 with corresponding color toner (for example, having a negative polarity in the exemplary embodiment). For example, the developing unit 33 is combined with the sub-cartridge constituted by the photoconductor unit 30 into a process cartridge.

The photoconductor unit 30 may, of course, be separated from the developing unit 33 so as to be a separated process cartridge. In an upper part of the body housing 21, toner cartridges 35 (specifically, 35*a*, 35*b*, 35*c*, and 35*d*, hereinafter referred to as "35*a* to 35*d*") are provided to supply color component toners to the corresponding developing units 33 (toner supply paths are not illustrated).

On the other hand, a unit case 41 of the exposure unit 40 contains, for example, four semiconductor lasers (not illustrated), one polygonal mirror 42, an imaging lens (not illustrated), and mirrors (not illustrated) corresponding to the photoconductor units 30. The exposure unit 40 is disposed to deflect and scan light from the semiconductor lasers corresponding to the color components by using the polygonal mirror 42 and to guide optical images to exposure points on the corresponding photoconductor drums 31 via the imaging lens and the mirrors.

In the exemplary embodiment, in the belt module 23, for example, the intermediate transfer belt 230 is laid between a pair of support rollers (one of them is a driving roller) 231 and 232, and first transfer devices (first transfer rollers in the exemplary embodiment) 51 are disposed at positions on a back side of the intermediate transfer belt 230 corresponding to the photoconductor drums 31 in the photoconductor units 30. By applying a voltage having a polarity opposite from the toner charging polarity to the first transfer devices 51, toner images on the photoconductor drums 31 are electrostatically transferred onto the intermediate transfer belt 230. Further, a second transfer device 52 is disposed at a portion of the intermediate transfer belt 230 corresponding to the support roller 232 on the downstream side of the most downstream image forming unit 22*d*. The second transfer device 52 second-transfers (collectively transfers) the first-transferred images on the intermediate transfer belt 230 onto a recording medium.

In the exemplary embodiment, the second transfer device 52 includes a second transfer roller 521 disposed in pressure contact with a toner-image bearing surface of the intermediate transfer belt 230, and a back roller (the support roller 232 in the exemplary embodiment) disposed on the back side of the intermediate transfer belt 230 to serve as a counter electrode to the second transfer roller 521. For example, the second transfer roller 521 is grounded, and a bias having the same polarity as the toner charging polarity is applied to the back roller (support roller 232).

Further, a belt cleaning device 53 is disposed at a position of the intermediate transfer belt 230 on the upstream side of the most upstream image forming unit 22*a*. The belt cleaning device 53 removes residual toner on the intermediate transfer belt 230.

The recording-medium supply cassette 24 is provided with a feed roller 61 that feeds out recording media. Transport rollers 62 are disposed just behind the feed roller 61 to transport the recording media, and the recording-medium transport path 25 located just in front of a second transfer portion is provided with registration rollers 63 that supply the recording media to the second transfer portion at a predetermined timing. On the other hand, a fixing device 66 is provided in a portion of the recording-medium transport path 25 located on the downstream side of the second transfer portion, and output rollers 67 for outputting recording media are provided on the downstream side of the fixing device 66. The output recording media are received by a paper output section 68 provided in the upper part of the body housing 21.

Further, in the exemplary embodiment, a manual supply device (MSI) 71 is provided beside the body housing 21. A recording medium on the manual supply device 71 is fed out toward the recording-medium transport path 25 by a feed roller 72 and the transport rollers 62.

Still further, the body housing 21 is provided with a duplex printing unit 73. When a duplex mode for recording images on both sides of a recording medium is selected, the duplex printing unit 73 takes in a recording medium having a recorded image on one side by reversing the output rollers 67 and using guide rollers 74 before the inlet, transports the recording medium by transport rollers 77 along an internal recording-medium return transport path 76, and supplies the recording medium to the registration rollers 63 again.

Next, a detailed description will be given of each cleaning device 34 disposed inside the image forming apparatus 10 of the tandem type illustrated in FIG. 1.

Figure 2:
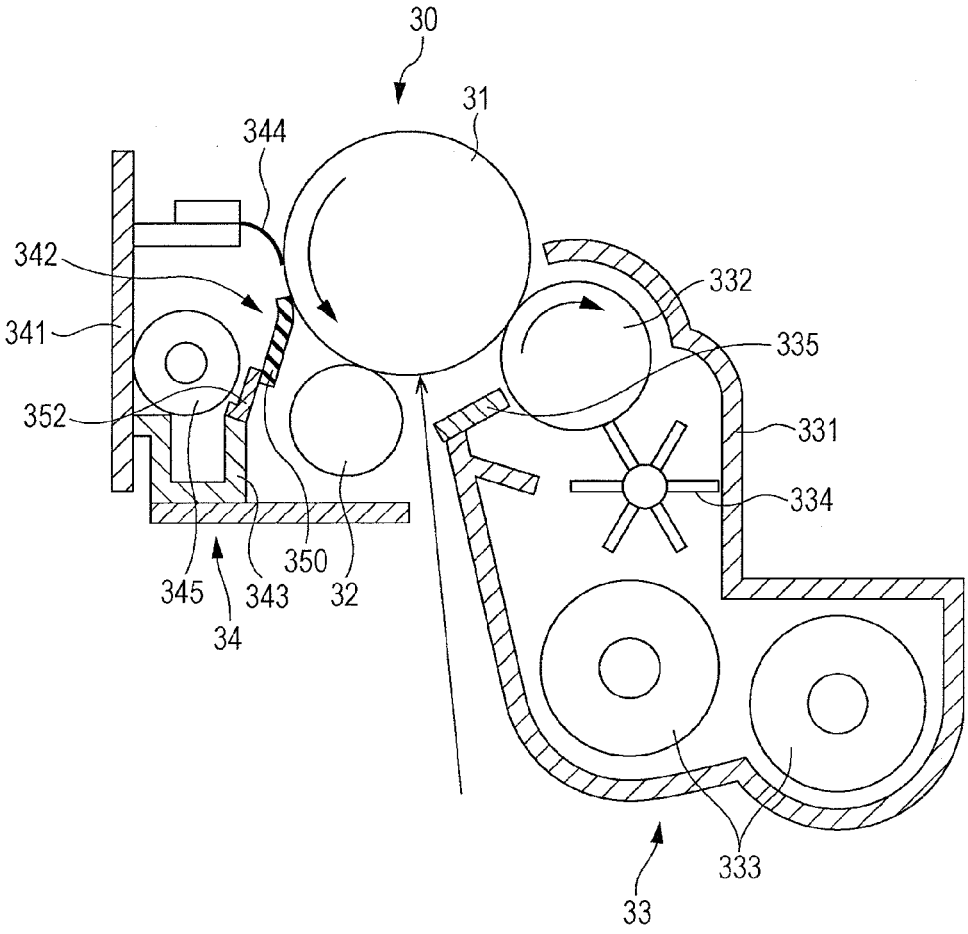
FIG. 2 is a cross-sectional side view of a cleaning device and a photoconductor drum used in the image forming apparatus illustrated in FIG. 1.

FIG. 2 is a cross-sectional side view illustrating the cleaning device 34 of the exemplary embodiment. FIG. 2 also illustrates the photoconductor drum 31, the charging roller 32, and the developing unit 33 that are combined with the cleaning device 34 illustrated in FIG. 1 into a sub-cartridge.

FIG. 2 illustrates a charging roller (charging device) 32, a unit case 331, a developing roller 332, a toner transport member 333, a transport paddle 334, a trimming member 335, a cleaning case 341, a cleaning member 342, a film seal 344, and a transport member 345.

The cleaning device 34 includes a cleaning case 341 that receives residual toner and has an opening opposed to the photoconductor drum 31. A cleaning member 342 disposed to be in contact with the photoconductor drum 31 is attached to a lower edge of the opening of the cleaning case 341 with a bracket 343 being disposed therebetween, and a film seal 344 is attached to an upper edge of the opening of the cleaning case 341 to keep the space between the cleaning case 341 and the photoconductor drum 31 airtight. The cleaning devices 34 further includes a transport member 345 provided on a back side (a side opposite from the photoconductor drum 31) of the cleaning member 342 to guide waste toner received in the cleaning case 341 to a side waste-toner container.

In the exemplary embodiment, all of the cleaning devices 34 in the image forming units 22 (22*a* to 22*d*) include the cleaning members 342 having cleaning blades 350 of the exemplary embodiment to be described later. Besides the cleaning members 342 having the cleaning blades 350, the cleaning member (cleaning blade) of the exemplary embodiment may also be used for a cleaning member 531 (cleaning blade) of the belt cleaning device 53.

Each developing unit (developing device) 33 used in the exemplary embodiment includes a unit case 331 that contains developer and has an opening opposed to the photoconductor drum 31, for example, as illustrated in FIG. 2. A developing roller 332 is disposed at a position facing the opening of the unit case 331, and toner transport members 333 for transporting and agitating developer are disposed inside the unit case 331. Further, a transport paddle 334 may be disposed between the developing roller 332 and the toner transport members 333.

In development, after the developer is supplied to the developing roller 332, it is transported to a developing area opposed to the photoconductor drum 31, for example, in a state in which the layer thickness of the developer is regulated by a trimming member 335.

While the developing unit 33 of the exemplary embodiment uses, for example, a two-component developer composed of toner and carriers, it may use a one-component developer composed of only toner.

Here, a description will be given of the cleaning member 342 used in the cleaning device 34.

Figure 3:
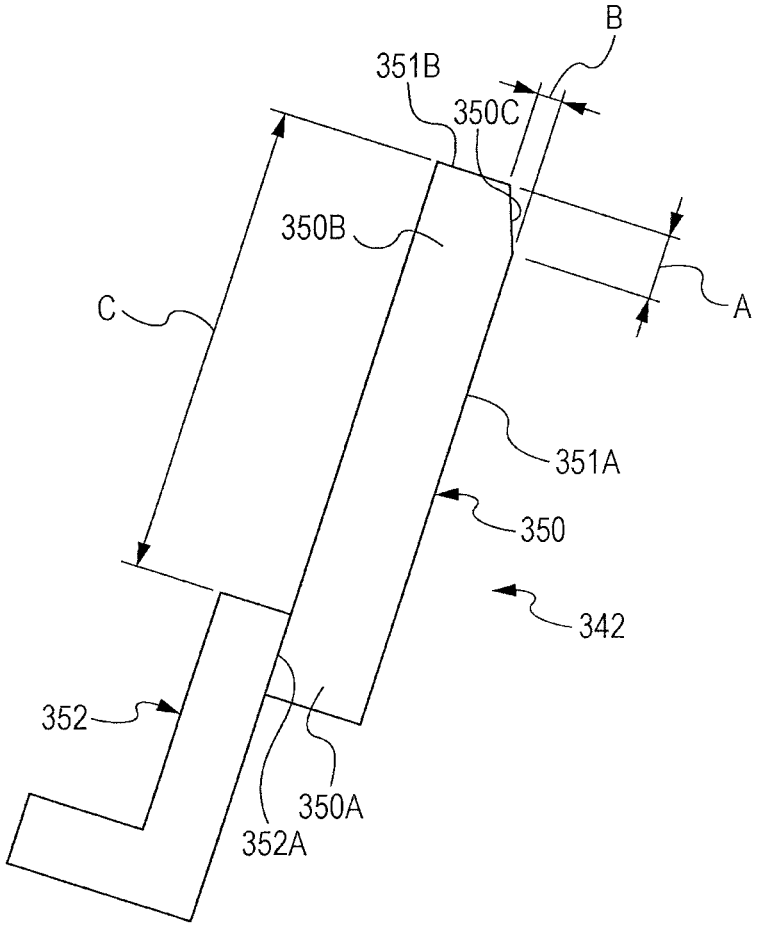
FIG. 3 is a side view of a cleaning blade used in the cleaning device illustrated in FIG. 2.

As illustrated in FIGS. 2 and 3, the cleaning member 342 includes a cleaning blade 350 to be in contact with the photoconductor drum 31 and a support portion 352 that supports the cleaning blade 350. The support portion 352 is substantially L-shaped in side cross section. A root portion 350A of the cleaning blade 350 is fixed to one end portion of the support portion 352, and the other end portion of the support portion 352 is fixed to a lower portion of the cleaning case 341 (see FIG. 2). A distal end portion 350B of the cleaning blade 350 is disposed in a posture such as to point toward the upstream side of the photoconductor drum 31 in the rotating direction while being supported by the support portion 352 (see FIG. 2).

Figure 4:
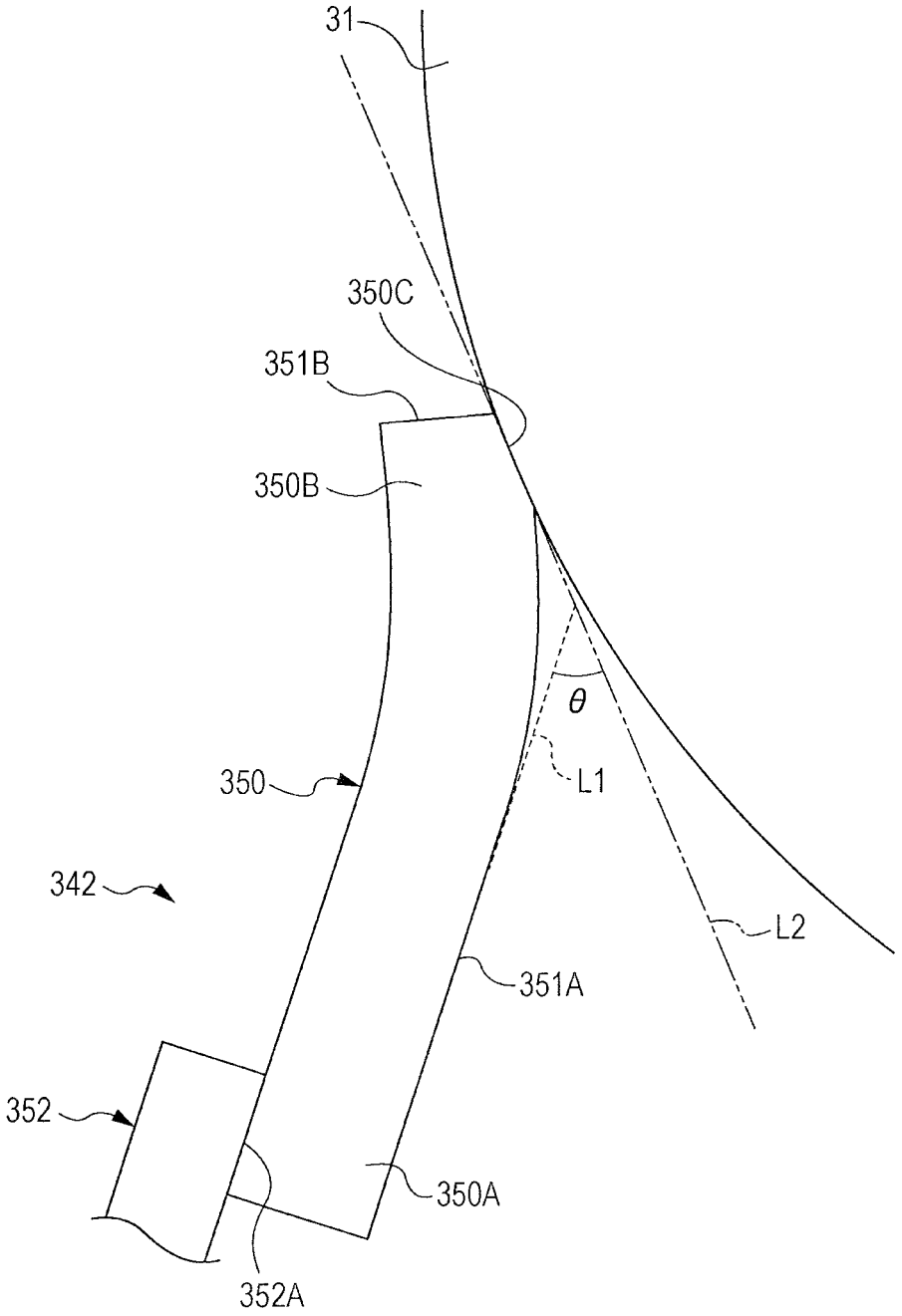
FIG. 4 is a side view illustrating the angle set when the cleaning blade used in the cleaning device illustrated in FIG. 2 is made in contact with the photoconductor drum.

As illustrated in FIGS. 3 and 4, the cleaning blade 350 is substantially rectangular in side cross section, and the distal end portion 350B of the cleaning blade 350 has an inclined surface 350C formed by cutting out a corner portion on a side of the photoconductor drum 31. The support portion 352 supports the cleaning blade 350 so that the inclined surface 350C of the cleaning blade 350 is in contact with an outer peripheral surface of the photoconductor drum 31 (see FIG. 2). In other words, the cleaning blade 350 is supported by the support portion 352 so that almost the entire inclined surface 350C is in flat contact with the outer peripheral surface of the photoconductor drum 31. The cleaning member 342 is configurated to be in contact with the photoconductor drum 31 in a posture such that the inclined surface 350C points toward the upstream side of the photoconductor drum 31 in the rotating direction. In the exemplary embodiment, the support portion 352 is formed of sheet metal, and the cleaning blade 350 is formed of an elastic material such as rubber. Specifically, the cleaning blade 350 is formed of, for example, urethane rubber, silicone rubber, acrylic rubber, acrylonitrile rubber, butadiene rubber, styrene rubber, or a composite material of these rubbers. The inclined surface 350C is made in contact with the photoconductor drum 31 by a biasing force generated by deflection of the distal end portion 350B of the cleaning blade 350 in a state in which the cleaning blade 350 is supported by the support portion 352 (see FIG. 4).

The inclined surface 350C of the cleaning blade 350 is formed, for example, by cutting the corner portion of the distal end portion 350B on the side of the photoconductor drum 31. Without cutting the corner portion, the cleaning blade 350 may be shaped using a die so as not to have the corner portion of the distal end portion 350B on the side of the photoconductor drum 31.

As illustrated in FIG. 3, when A represents a cutout length of a side surface 351A of the cleaning blade 350 opposed to the photoconductor drum 31 (a length along the side surface 351A) and B represents a cutout length of an end surface 351B of the cleaning blade 350 (a length along the end surface 351B) when the cleaning blade 350 is in a free state (a state in which the cleaning blade 350 is not in contact with the photoconductor drum 31), $A \geq B$. In other words, it is only necessary that an angle formed between the inclined surface 350C of the cleaning blade 350 and an extension line of the side surface 351A of the cleaning blade 350 on the side of the inclined surface 350C should be 45° or less.

In the exemplary embodiment, the free length of the cleaning blade 350 (C in FIG. 3, a length from an end surface of the support portion 352 to the end surface 351B of the cleaning blade 350) is set at about 8 mm, and the thickness of the cleaning blade 350 (a thickness in a direction substantially orthogonal to the side surface 351A) is set at about 2.0 mm. In the exemplary embodiment, the cleaning blade 350 is formed of rubber, and the hardness thereof measured with an MD-1 hardness tester is about 75 degrees.

As illustrated in FIG. 4, the cleaning member 342 is disposed so that an angle θ formed between a line L1 along a side surface 352A of the support portion 352 on the side of the cleaning blade 350 (a line substantially parallel to the side surface 352A) and a tangent L2 to a center portion of the photoconductor drum 31 (a center portion in the circumferential direction) to be in contact with the inclined surface 350C becomes about 23 degrees. This angle θ is a setting angle of the cleaning member 342.

Here, a description will be given of the photoconductor drum 31 used in the image forming apparatus 10.

Figure 5:
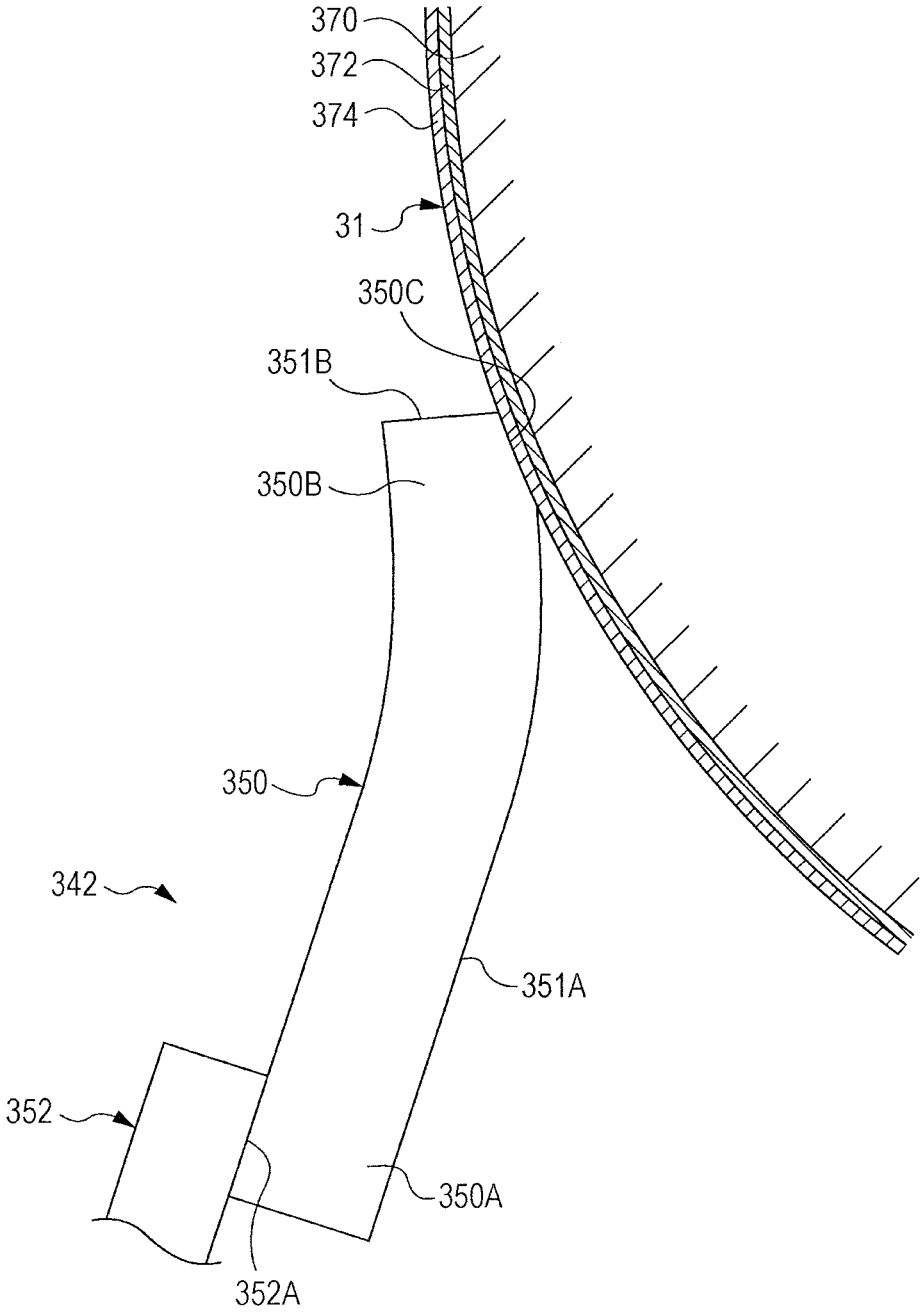
FIG. 5 is a side view illustrating a state in which the cleaning blade used in the cleaning device illustrated in FIG. 2 is in contact with the photoconductor drum.

As illustrated in FIG. 5, the photoconductor drum 31 includes a conductive base body 370, an organic photosensitive layer 372 provided on the conductive base body 370, and an inorganic protective layer 374 provided on the organic photosensitive layer 372. For example, the inorganic protective layer 374 may be formed by a single layer or may have a multilayer structure in which an interface layer, an intermediate layer, and an outermost layer are stacked in this order from the side of the organic photosensitive layer 372. For example, the organic photosensitive layer 372 includes a charge generating layer containing a charge generating material and a binder resin, and a charge transport layer stacked on the charge generating layer to contain a charge transport organic material and to contain a binder resin as necessary.

Composition of Inorganic Protective Layer

The inorganic protective layer contains an inorganic material.

Examples of the inorganic material include oxide-based, nitride-based, carbon-based, and silicon-based organic materials from the viewpoint of mechanical strength and translucency as the protective layer.

Examples of the oxide-based inorganic material include oxides, such as gallium oxide, aluminum oxide, zinc oxide, titanium oxide, indium oxide, tin oxide, boron oxide, and silicon oxide, or a mixed crystal of these oxides.

Examples of the nitride-based inorganic material include nitrides, such as gallium nitride, aluminum nitride, zinc nitride, titanium nitride, indium nitride, tin nitride, boron nitride, and silicon nitride, or a mixed crystal of these nitrides.

Examples of the carbon-based and silicon-based inorganic materials include diamond-like carbon (DLC), amorphous carbon (a-C), hydrogenated amorphous carbon (a-C:H), fluorinated and hydrogenated amorphous carbon (a-C:H), amorphous silicon carbide (a-SiC), and hydrogenated amorphous silicon carbide (a-SiC:H).

The inorganic material may be a mixed crystal of oxide-based and nitride-based inorganic materials.

Among these, as the inorganic material, metal oxide, especially, an oxide of a group 13 element (preferably gallium oxide) is suitable because it is excellent in mechanical strength and translucency, particularly has an n-type conductivity, and is excellent in conductivity controllability.

That is, the inorganic protective layer preferably contains at least a group 13 element (especially gallium) and oxygen, and may further contain hydrogen as necessary. When the inorganic protective layer contains hydrogen, various physical properties of the inorganic protective layer containing at least the group 13 element (especially gallium) and oxygen are controlled easily. For example, in an inorganic protective layer containing gallium, oxygen, and hydrogen (an inorganic protective layer formed of gallium oxide containing hydrogen), the volume resistivity may be easily controlled within the range of 109 to 1014 Ω·cm by changing the composition ratio [O]/[Ga] from 1.0 to 1.5.

To control the conductivity type, for example, when the conductivity type is an n-type, the inorganic protective layer may contain one or more elements selected from C, Si, Ge, and Sn in addition to the above-described inorganic material. For example, when the conductivity type is a p-type, the inorganic protective layer may contain one or more elements selected from N, Be, Mg, Ca, and Sr.

When the inorganic protective layer contains gallium and oxygen and further contains hydrogen as necessary, the following elemental component ratios are suitable from the viewpoints of mechanical strength, translucency, flexibility, and conduction controllability.

For example, the elemental component ratio of gallium is preferably within the range of 15 to 50 at %, more preferably within the range of 20 to 40 at %, and still more preferably within the range of 20 to 30 at % with respect to all the elemental components of the inorganic protective layer.

For example, the elemental component ratio of oxygen is preferably within the range of 30 to 70 at %, more preferably within the range of 40 to 60 at %, and still more preferably within the range of 45 to 55 at % with respect to all the elemental components of the inorganic protective layer.

For example, the elemental component ratio of hydrogen is preferably within the range of 5 to 40 at %, more preferably within the range of 15 to 35 at %, and still more preferably within the range of 20 to 30 at % with respect to all the elemental components of the inorganic protective layer.

On the other hand, the atomic number ratio (oxygen/gallium) is preferably higher than 1.0 and lower than or equal to 2.0, and more preferably within the range of 1.1 to 1.5.

The elemental component ratio, atomic number ratio, and so on of each element in the inorganic protective layer are obtained by Rutherford backscattering spectrometry (hereinafter, referred to as "RBS") including the distribution in the thickness direction.

In RBS, 3SDH Pelletron from NEC Corporation is used as an accelerator, RBS-400 from CE&A Co., Ltd is used as an end station, and 3S-R10 is used as a system. For example, a HYPRA program from CE&A Co., Ltd. is used for analysis.

Measurement conditions of RBS are such that the He++ ion beam energy is 2.275 eV, the detection angle is 160°, and the grazing angle with respect to incident beams is about 109°.

Specifically, RBS measurement is performed as follows.

First, He++ ion beams are made vertically incident on a sample, a detector is set at 160° with respect to the ion beams, and backscattered He signals are measured. The composition ratio and layer thickness are determined from the detected energy and intensity of He. To improve the accuracy in finding the composition ratio and layer thickness, a spectrum may be measured at two detection angles. The accuracy is improved by performing the measurement at two detection angles having different resolutions in the depth direction and different backscattering mechanical properties and by cross-checking the values.

The number of He atoms that are backscattered by a target atom is determined by only three elements, that is, 1) the atomic number of the target atom, 2) the energy of He atoms before scattering, and 3) the scattering angle.

The density is assumed by calculation from a measured composition, and the thickness is calculated using the assumed density. The error range of the density is within 20%.

The elemental component ratio of hydrogen is obtained by hydrogen forward scattering (hereinafter, referred to as "HFS") measurement.

In HFS measurement, 3SDH Pelletron from NEC Corporation is used as an accelerator, RBS-400 from CE&A Co., Ltd. is used as an end station, and 3S-R10 is used as a system. A HYPRA program from CE&A Co., Ltd. is used for analysis. Measurement conditions of HFS are as follows:

He++ ion beam energy: 2.275 eV;

Detection angle: 160°; and

Grazing angle with respect to incident beams: 30°

In HFS measurement, a detector is set to 30° with respect to He++ ion beams and a sample is set to form 75° with the normal line to pick up hydrogen signals scattered forward from the sample. At this time, it is preferable that the detector be covered with aluminum foil to remove He atoms scattered together with hydrogen. Quantification is performed by normalizing the amounts of hydrogen of a reference sample and a measurement sample with stopping power and then comparing values thereof. As the reference sample, a sample obtained by ion-implanting H into Si and muscovite are used.

Muscovite is known to have a hydrogen concentration of 6.5 at %.

For example, the amount of H adsorbed on the outermost surface is corrected by subtracting the amount of H adsorbed on a clean Si surface therefrom.

Characteristics of Inorganic Protective Layer

The inorganic protective layer may have a composition ratio distribution in the thickness direction or may have a multilayer structure according to the intended use.

It is preferable that the inorganic protective layer be a non-single crystalline film such as a microcrystalline film, a polycrystalline film, or an amorphous film. Among these, an amorphous film is particularly preferable from the viewpoint of surface smoothness, and a microcrystalline film is more preferable from the viewpoint of hardness.

While a growth cross section of the inorganic protective layer may have a columnar structure, a high-flatness structure is preferable from the viewpoint of sliding property, and an amorphous structure is preferable.

Whether the inorganic protective layer is crystalline or amorphous is identified on the basis of whether or not there are points and lines in a diffraction image obtained by reflection high-energy electron diffraction (RHEED).

The volume resistivity of the inorganic protective layer is preferably 106 Ω·cm or more, and more preferably 108 Ω·cm or more.

When the volume resistivity is within the above-described range, flow of charges in the in-plane direction may be suppressed, and good formation of an electrostatic latent image may be easily achieved.

The volume resistivity is obtained using an LCR meter ZM2371 from NF Corporation by calculating from the resistance value measured under the conditions that the frequency is 1 kHz and the voltage is 1 V, on the basis of the electrode area and the thickness of the sample.

The measurement sample may be obtained by forming a film on an aluminum substrate under the same condition as the forming condition of the inorganic protective layer to be measured and forming a gold electrode on the formed film by vacuum deposition, or may be obtained by peeling the inorganic protective layer from a prepared electrophotographic photoconductor, partly etching the inorganic protective layer, and putting the inorganic protective layer between a pair of electrodes.

The elastic modulus of the inorganic protective layer is preferably within the range of 30 to 80 GPa, and more preferably within the range of 40 to 65 GPa.

When the elastic modulus is within the above-described range, the occurrence of concave portions (dent scratches), peeling, and cracking may be easily suppressed in the inorganic protective layer.

The elastic modulus is obtained by a method in which a depth profile is obtained using Nano Indenter SA2 from MTS Systems Corporation according to continuous stiffness measurement (CSM; U.S. Pat. No. 4,848,141) and the average of measured values at an indentation depth of 30 to 100 nm is obtained. Measurement conditions are as follows:

Measurement environment: 23° C., 55% RH;

Used indenter: diamond triangular pyramidal indenter (Berkovic indenter); and

Test mode: CSM mode.

The measurement sample may be obtained by forming a film on a base material under the same conditions as the forming conditions of the inorganic protective layer that is a measurement target, or may be obtained by peeling off an inorganic protective layer from a prepared electrophotographic photoreceptor and partly etching the inorganic protective layer.

For example, the layer thickness of the inorganic protective layer is preferably within the range of 0.2 to 10.0 μm and more preferably within the range of 0.4 to 5.0 μm.

When the layer thickness is within the above-described range, the occurrence of concave portions (dent scratches), peeling, and cracking may be easily suppressed in the inorganic protective layer.

Formation of Inorganic Protective Layer

For formation of the inorganic protective layer (when the inorganic protective layer has a multilayer structure, formation of each layer), for example, a well-known vapor deposition method, such as plasma chemical vapor deposition (CVD), organometallic vapor deposition, molecular beam epitaxy, vapor deposition, or sputtering, is used.

Next, the operations and effects of the image forming apparatus 10 according to the exemplary embodiment will be described.

First, the action of the image forming apparatus 10 will be described. When the image forming units 22 (22*a* to 22*d*) form one-colored toner images corresponding to the colors, the one-colored toner images are sequentially superimposed and first-transferred onto the surface of the intermediate transfer belt 230 so as to form a color toner image that matches original document information. Next, the color toner image transferred on the surface of the intermediate transfer belt 230 is transferred onto the surface of a recording medium by the second transfer device 52, and the recording medium on which the color toner image is transferred is output to the paper output section 68 after being subjected to fixing in the fixing device 66.

On the other hand, residual toner on the photoconductor drums 31 in the image forming units 22 (22*a* to 22*d*) is removed by the cleaning members 342 in the cleaning devices 34. Further, residual toner on the intermediate transfer belt 230 is removed by the cleaning member 531 in the belt cleaning device 53.

In this image forming apparatus 10, the inorganic protective layer 374 is provided on the surface of the organic photosensitive layer 372 in each photoconductor drum 31, as described above. In the exemplary embodiment, for example, the inorganic protective layer 374 is formed of amorphous gallium oxide containing hydrogen (hydrogenated amorphous gallium oxide). The friction coefficient of the surface of the photoconductor drum 31 having the inorganic protective layer 374 with respect to toner and adhesion of toner and external additives thereto are lower than those of an organic photoconductor having no inorganic protective layer. The friction coefficient of the inorganic protective layer 374 with respect to toner is set at, for example, 0.15 to 0.35, and is lower than the friction coefficient (for example, 0.4 to 0.6) of the organic photoconductor with respect to toner. The friction coefficient is a value obtained by measurement with a variable normal load friction and wear measurement system TYPE: HHS2000 (from SHINTO Scientific Co., Ltd) under measurement conditions that the radius of the sapphire needle is 0.2 mm, the travel speed is 10 mm/sec, and the load is 20 g.

As the material of the inorganic protective layer 374, gallium oxide is dominant in terms of friction coefficient.

Figure 10:
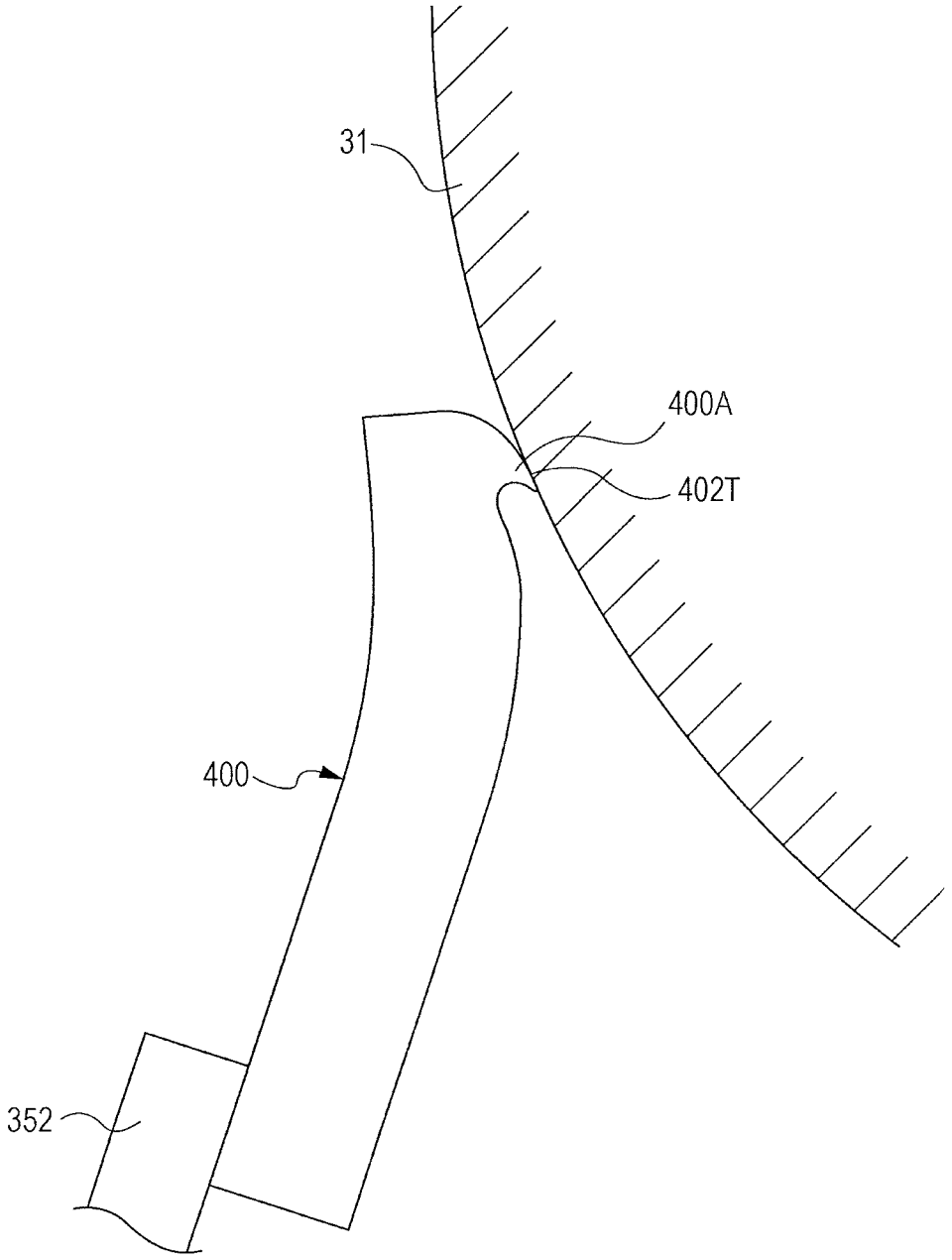
FIG. 10 is a side view illustrating a tuck state in which a distal corner portion of a cleaning blade is in contact with a photoconductor drum in an image forming apparatus of a fourth comparative example.

For example, in a photoconductor drum formed by an organic photoconductor (a photoconductor drum having no inorganic protective layer), as illustrated in FIG. 10, toner and external additives are cleaned off while increasing the linear pressure by making a distal corner portion 400A of a substantially rectangular cleaning blade 400 in contact with the photoconductor drum at a nip portion 402T in a tuck state. At this time, if the distal corner portion 400A of the cleaning blade 400 abrades and the cleaning blade 400 cannot be in contact with the photoconductor drum in the tuck state, cleaning failure occurs. If the distal corner portion 400A of the cleaning blade 400 is partly chipped, cleaning failure occurs, and a linear streak occurs on an image. To lengthen the life of the image forming apparatus (including the process cartridge), abrasion-resistant performance is required so that the distal corner portion 400A of the cleaning blade 400 is not chipped.

In contrast, in the cleaning member 342 of the exemplary embodiment, the cleaning blade 350 is supported by the support portion 352 in a manner such that the inclined surface 350C formed by cutting out the corner portion of the cleaning blade 350 on the side of the photoconductor drum 31 is in contact with the photoconductor drum 31.

In the cleaning member 342, the cutout length A of the side surface 351A of the cleaning blade 350 opposed to the photoconductor drum 31 and the cutout length B of the end surface 351B of the cleaning blade 350 have the relation that A≥B (see FIG. 3).

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

For example, the above-described inorganic protective layer 374 may be provided on the surface of the intermediate transfer belt 230 used in the image forming apparatus 10, and the inclined surface 350C of the cleaning member 342 (cleaning blade 350) of the exemplary embodiment may be in contact with the intermediate transfer belt 230. Although not illustrated, even in an image forming apparatus including an intermediate transfer body formed by a drum or the like, instead of the intermediate transfer belt 230, the above-described inorganic protective layer 374 may be provided on the surface of the intermediate transfer body, and the inclined surface 350C of the cleaning member 342 (cleaning blade 350) of the exemplary embodiment may be in contact with the intermediate transfer body.

In the exemplary embodiment, the term "image forming apparatus" also includes, for example, a process cartridge that is detachably mounted in the image forming apparatus body and that has the photoconductor drum 31, the cleaning blade 350, and the support portion 352 for the cleaning blade 350.

EXAMPLES

As an image forming apparatus according to an example, the image state is evaluated while changing the size of an inclined surface 350C of a cleaning blade 350 in a cleaning member 342 by using a photoconductor drum 31 having an inorganic protective layer 374 formed of amorphous gallium oxide containing hydrogen (hydrogenated amorphous gallium oxide). In the image forming apparatus of the example, after 200,000 A4-sized sheets are printed, the degree of a linear streak on an image is evaluated.

Figure 6:
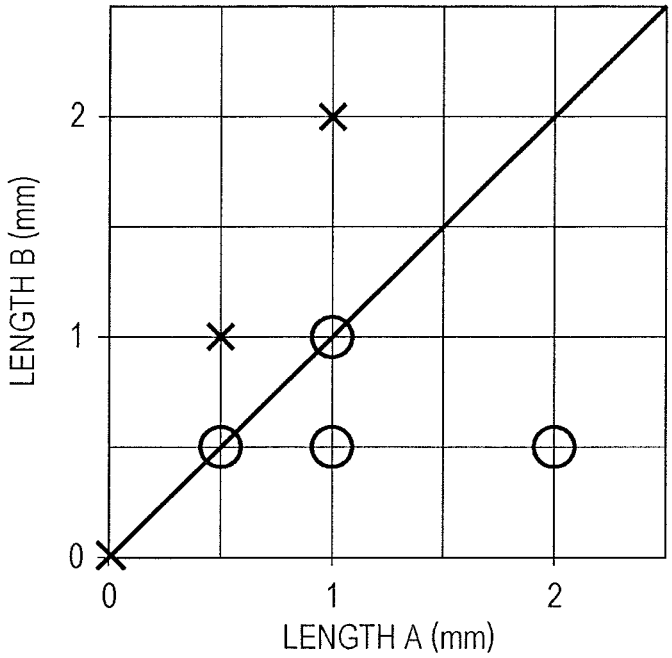
FIG. 6 is a graph showing the state of a linear streak on an image in the image forming apparatus of the exemplary embodiment using the photoconductor drum with the inorganic protective layer when a cutout length A of a side surface of the cleaning blade opposed to the photoconductor drum and a cutout length B of an end surface of the cleaning blade are changed.

The size of the inclined surface 350C of the cleaning blade 350 is changed by changing the cutout length A of a side surface 351A opposed to the photoconductor drum 31 and the cutout length B of an end surface 351B of the cleaning blade 350. At this time, the setting angle θ of the cleaning member 342 is fixed, and the inclined surface 350C of the cleaning blade 350 is disposed in contact with the photoconductor drum 31. FIG. 6 shows evaluation results of a linear streak on an image. In FIG. 6, an open circle means a good case in which a linear streak hardly occurs on the image, and a cross means a poor case in which a linear streak occurs on the image.

FIG. 6 shows that a linear streak hardly occurs and a good state is obtained when the above-described lengths A and B of the inclined surface 350C of the cleaning blade 350 have the relationship that A≥B.

Figure 7:
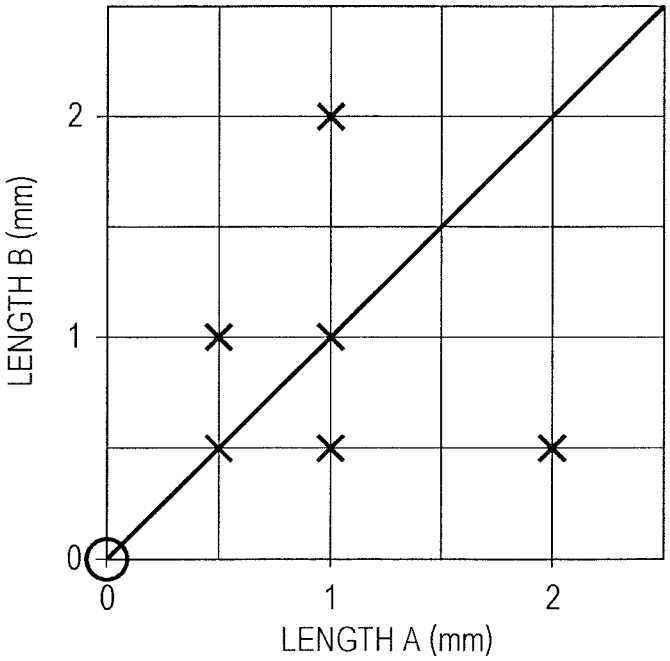
FIG. 7 is a graph showing the state of a linear streak on an image in an image forming apparatus of a first comparative example using an organic photoconductor drum when a cutout length A of a side surface of a cleaning blade opposed to the photoconductor drum and a cutout length B of an end surface of the cleaning blade are changed.

As a first comparative example, a photoconductor drum formed by an organic photoconductor (a photoconductor drum having no inorganic protective layer) is used. After 200,000 A4-sized sheets are printed while changing the above lengths A and B of an inclined surface 350C of a cleaning blade 350, the degree of a linear streak on an image is evaluated. FIG. 7 shows evaluation results of a linear streak on an image. Similarly to FIG. 6, in FIG. 7, an open circle means a good case in which a linear streak hardly occurs on the image, and a cross means a poor case in which a linear streak occurs on the image.

As illustrated in FIG. 7, it is confirmed that a linear streak hardly occurs on the image and a good state is obtained only when the cleaning blade 350 is not cut (when A=0, B=0, and the inclined surface 350C is not formed). That is, when the inclined surface 350C is formed in the cleaning blade 350, a linear streak occurs on the image and the state is poor. It is supposed that, since the photoconductor drum formed by an organic photoconductor has a higher surface friction coefficient and higher adhesion of toner or the like thereto than those of the photoconductor drum 31 having the inorganic protective layer 374, when the inclined surface 350C of the cleaning blade 350 is in contact with the photoconductor drum, the linear pressure is insufficient and cleaning performance decreases.

Figure 8:
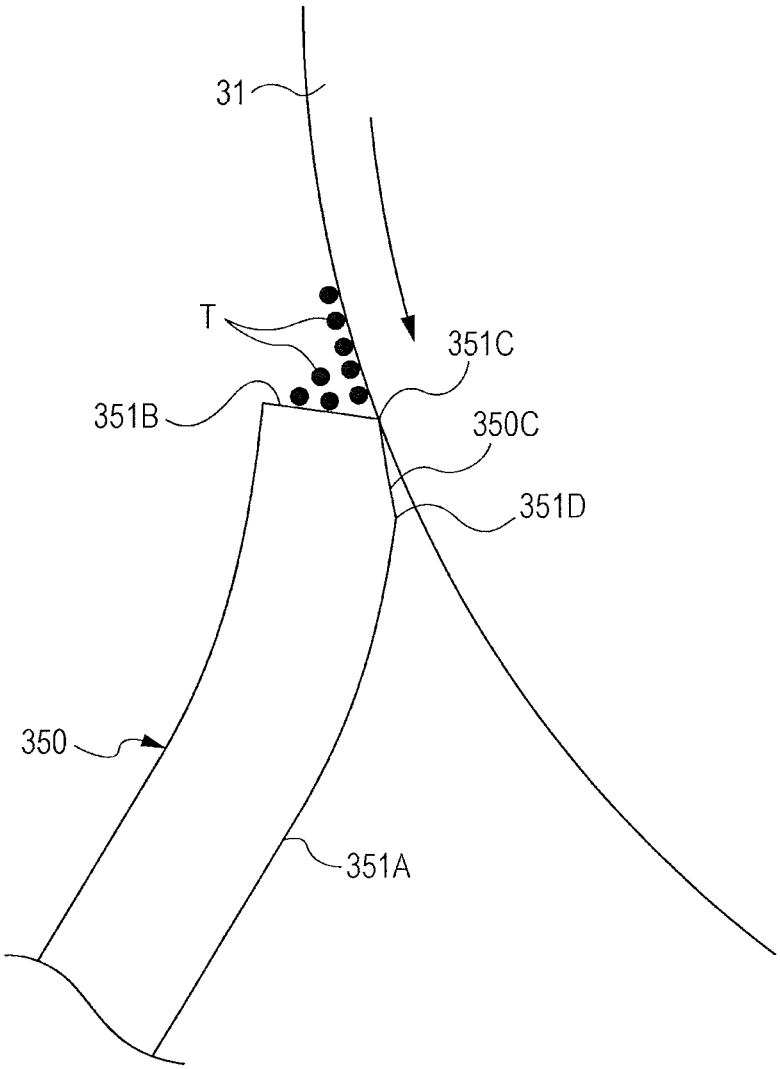
FIG. 8 is a side view schematically illustrating a state in which a distal end of an inclined surface of a cleaning blade is in contact with a photoconductor drum in a second comparative example.

FIG. 8 illustrates a structure of a second comparative example in which a distal end 351C (on a side of an end surface 351B) of an inclined surface 350C of a cleaning blade 350 is in contact with a photoconductor drum 31. In the second comparative example, the photoconductor drum 31 has an inorganic protective layer 374 (see FIG. 5). As illustrated in FIG. 8, in a case in which the photoconductor drum 31 having a low surface friction coefficient is cleaned, when the distal end 351C of the inclined surface 350C of the cleaning blade 350 is in contact with the photoconductor drum 31, toner T is held back on the side of the distal end 351C (side of the end surface 351B). For this reason, it is considered that the cleaning performance for the photoconductor drum 31 is improved. However, since the distal end 351C (on the side of the end surface 351B) of the inclined surface 350C of the cleaning blade 350 is in contact with the photoconductor drum 31, it may be abraded.

Figure 9:
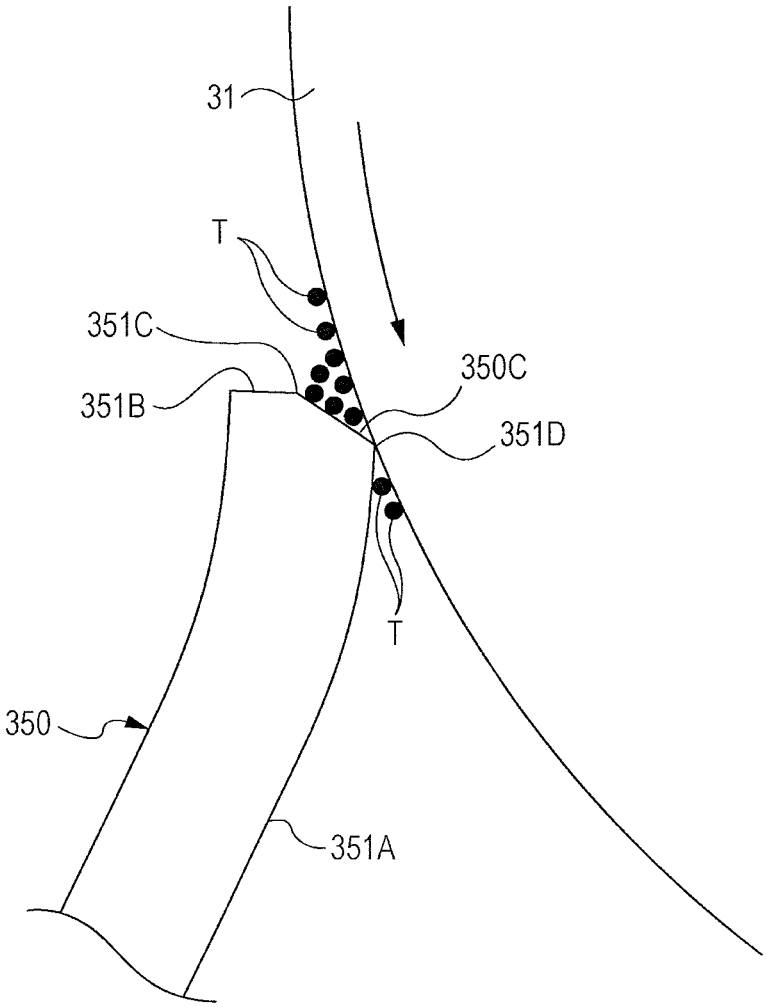
FIG. 9 is a side view schematically illustrating a state in which a proximal end of an inclined surface of a cleaning blade is in contact with a photoconductor drum in a third comparative example.

FIG. 9 illustrates a structure of a third comparative example in which a proximal end 351D (on a side of a side surface 351A) of an inclined surface 350C of a cleaning blade 350 is in contact with a photoconductor drum 31. In the third comparative example, the photoconductor drum 31 has an inorganic protective layer 374 (see FIG. 5). As illustrated in FIG. 9, when the proximal end 351D of the inclined surface 350C of the cleaning blade 350 is in contact with the photoconductor drum 31, toner T enters a wedge formed between the side surface 351A of the cleaning blade 350 and the photoconductor drum 31. It is considered that the toner T entering the wedge pushes up the cleaning blade 35 and this reduces cleaning performance.

FIG. 10 illustrates a structure of a fourth comparative example in which a distal corner portion 400A of a substantially rectangular cleaning blade 400 (the cleaning blade 400 does not have a cut) is made in contact with a photoconductor drum 31 in a free state (a state out of contact with the photoconductor drum 31). As illustrated in FIG. 10, when the distal corner portion 400A of the cleaning blade 400 is in contact with the photoconductor drum 31, a nip portion 402T where the distal corner portion 400A warps back in the rotating direction of the photoconductor drum 31 is caused by sliding of contact portions of the distal corner portion 400A and the photoconductor drum 31. That is, the distal corner portion 400A of the cleaning blade 400 is made in contact with the photoconductor drum 31 in a tuck state by the nip portion 402T.

Figure 11:
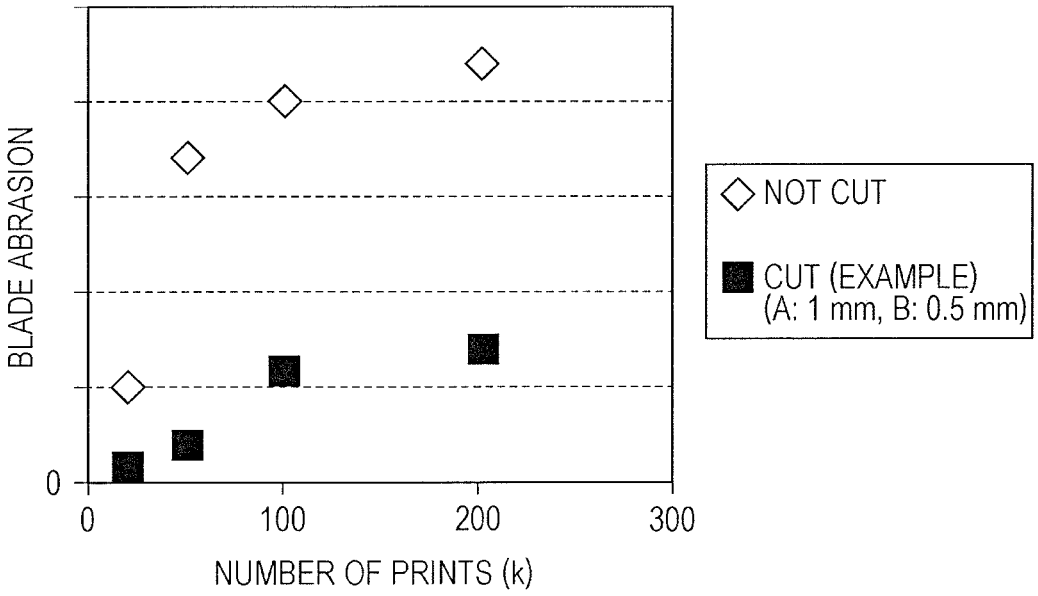
FIG. 11 is a graph showing the abrasion state of the distal end of the cleaning blade with respect to the number of prints in the cleaning blade of the exemplary embodiment and the cleaning blade of the fourth comparative example.

FIG. 11 is a graph showing comparison of abrasion states of cleaning blade pieces in the structure of the fourth comparative example in which the distal corner portion 400A (having no cut) of the cleaning blade 400 is in contact with the photoconductor drum 31 (see FIG. 10) and the structure of the example in which the inclined surface 350C (having a cut) of the cleaning blade 350 is in contact with the photoconductor drum 31 (see FIG. 5). In the cleaning blade 350 (having a cut) of the example, the cutout length A of the side surface 351A of the cleaning blade 350 opposed to the photoconductor drum 31 is set at 1 mm, and the cutout length B of the end surface 351B of the cleaning blade 350 is set at 0.5 mm.

As shown in FIG. 11, in the structure of the fourth comparative example in which the distal corner portion 400A (having no cut) of the cleaning blade 400 is in contact with the photoconductor drum 31 (see FIG. 10), when the number of prints increases, the distal corner portion 400A of the cleaning blade 400 is rapidly abraded.

In contrast, as shown in FIG. 11, in the structure of the example in which the inclined surface 350C (having a cut) of the cleaning blade 350 is in flat contact with the photoconductor drum 31 (see FIG. 5), if the number of prints increases, a sudden increase in abrasion of the inclined surface 350C of the cleaning blade 350 is not found, and the inclined surface 350C is abraded at a substantially constant rate.

What is claimed is:

1. An image forming apparatus comprising:

an image bearing member having an inorganic protective layer on a surface thereof;

a cleaning blade having an inclined surface cut out at a corner portion on a side of the image bearing member; and a support portion that supports the cleaning blade so that the inclined surface is in contact with the image bearing member, wherein the following condition is satisfied:

$$A \geq B$$

where A represents a cutout length of a side surface of the cleaning blade opposed to the image bearing member, and B represents a cutout length of an end surface of the cleaning blade.

2. The image forming apparatus according to claim 1, wherein the cleaning blade is in contact in a posture such that the inclined surface points toward an upstream side of the image bearing member in a rotating direction.

3. The image forming apparatus according to claim 2, wherein the inorganic protective layer is formed of gallium oxide.

4. The image forming apparatus according to claim 1, wherein the inorganic protective layer is formed of gallium oxide.

5. An image forming apparatus comprising:

an image bearing member having an inorganic protective layer on a surface thereof;

a cleaning blade having an inclined surface cut out at a corner portion on a side of the image bearing member; and a support portion that supports the cleaning blade so that the inclined surface is in contact with the image bearing member, wherein at least a middle portion of the inclined surface along a rotating direction of the image bearing member is in contact with the image bearing member.

6. An image forming apparatus comprising:

an image bearing member having an inorganic protective layer on a surface thereof; and a cleaning blade having an inclined surface cut out at a corner portion on a side of the image bearing member;

wherein the inclined surface is in contact with the image bearing member, and wherein the following condition is satisfied:

$$A \geq B$$

where A represents a cutout length of a side surface of the cleaning blade opposed to the image bearing member, and B represents a cutout length of an end surface of the cleaning blade.

* * * * *